United States Patent [19]

Dürr

[11] 4,107,792

[45] Aug. 15, 1978

[54] APPARATUS FOR DISCONTINUOUS MIXING OF AT LEAST TWO MATERIALS

[75] Inventor: Herbert Dürr, Mannheim, Germany

[73] Assignee: Draiswerke GmbH, Mannheim-Waldhof, Germany

[21] Appl. No.: 807,391

[22] Filed: Jun. 16, 1977

[30] Foreign Application Priority Data

Jun. 19, 1976 [DE] Fed. Rep. of Germany ..... 2627600

[51] Int. Cl.[2] ..... B01F 7/16

[52] U.S. Cl. ..... 366/302; 366/304

[58] Field of Search ..... 259/DIG. 30, 107, 108, 259/7, 8, 23, 24, 43, 44, 66, 67, 96; 366/302, 304

[56] References Cited

U.S. PATENT DOCUMENTS

| | | | |
|---|---|---|---|
| 215,169 | 5/1879 | Scivalley | 259/107 |
| 2,009,957 | 7/1935 | Esch | 259/DIG. 30 |
| 2,322,720 | 6/1943 | Scott et al. | 259/108 X |
| 2,619,330 | 11/1952 | Willems | 259/DIG. 30 |
| 2,651,582 | 9/1953 | Courtney | 259/107 X |

FOREIGN PATENT DOCUMENTS

| | | | |
|---|---|---|---|
| 636,454 | 10/1936 | Fed. Rep. of Germany | 259/DIG. 30 |
| 1,186,031 | 1/1965 | Fed. Rep. of Germany. | |

OTHER PUBLICATIONS

Kolln-Engels, *Betriebshandbuch der Lackherstellung, Apparate,* Maschinen und Gerate, 1959, pp. 128, 129.

*Primary Examiner*—Philip R. Coe
*Attorney, Agent, or Firm*—Browdy & Neimark

[57] ABSTRACT

An apparatus for discontinuous mixing of at least two substances, of which at least one is a liquid, includes a container and a mixer which is disposed in the container. The mixer has a rotor drivable at high speed and a stator, the rotor and stator are provided with teeth disposed on mutually concentric circles. When the teeth move past one another, shearing slots are formed. In order to reduce the energy input and to reduce the required mixing time and/or improve the mixing results, at least the radially outermost circle of teeth on the rotor is disposed outside the radially outermost circle of teeth on the stator.

8 Claims, 5 Drawing Figures

FIG. 2
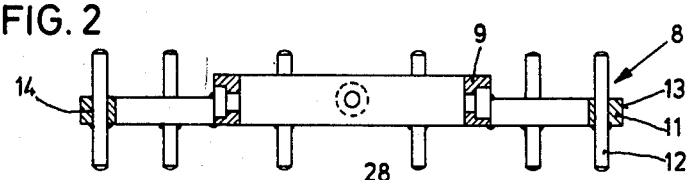
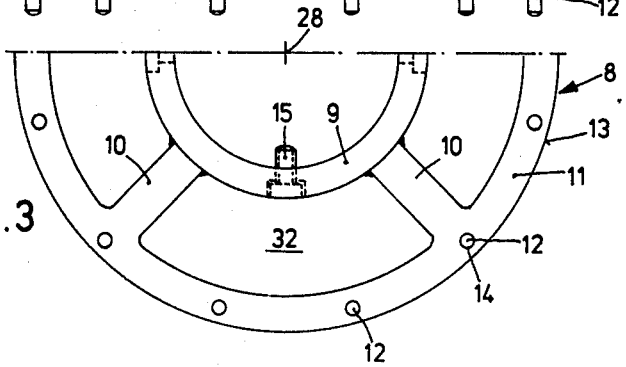
FIG. 3
FIG. 4
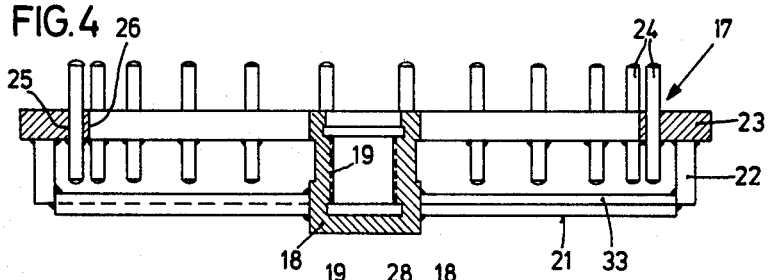
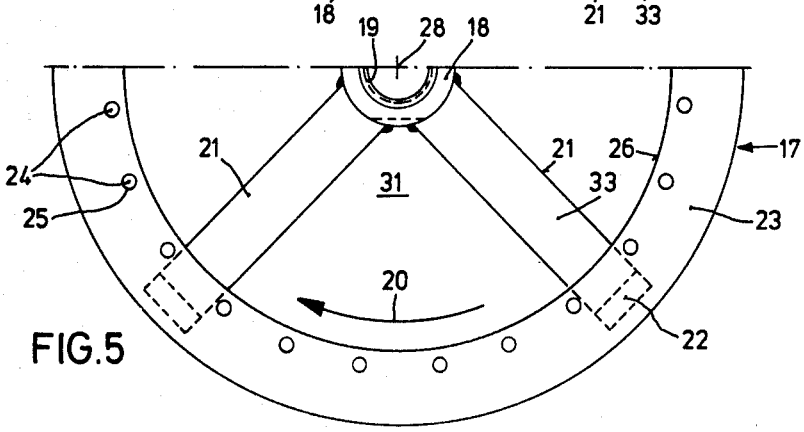
FIG. 5

APPARATUS FOR DISCONTINUOUS MIXING OF AT LEAST TWO MATERIALS

BACKGROUND OF THE INVENTION

This invention relates to an apparatus for discontinuous mixing of at least two materials, at least one of which is a liquid. The present invention relates, more particularly to such an apparatus which includes a container and a mixer disposed in the container, the mixer having a rotor drivable at high speed through a shaft and a stator, which are provided with teeth which are positioned on mutually concentric circles and move past one another to form shearing slots.

An apparatus of this kind is known from the book by Kölln-Engels entitled "Betriebshandbuch der Lackherstellung, Apparate, Maschinen, Geräte", (Operational Handbook of Paint Manufacture, Apparatus, Machinery, and Devices), 1959, pp. 128 and 129. In the book, a so-called rod cage mixer is described, which is provided with a rotor having a circle of fixed rods mounted around it, by means of which the materials to be mixed are beaten. This known apparatus is very well suited for the distribution of powdered components, which can also contain larger solid conglomerates, in liquids. Nevertheless, when the consistency increases, these known apparatus have been no longer usable, because they are unable to provide the necessary total flow for the materials to be mixed. In order to increase the beating effect, additional fixed or even counter-rotating rod systems have been provided. This known design is of a complicated construction however and extremely sensitive. In addition, the apparatus thus constructed does not ensure satisfactory circulation of the entire contents of the container.

In view of these problems, it has thus far remained conventional to use mixers for mixing, i.e., for dispersal of solids in liquids and for mixing of liquids in liquids, which are provided with a disk mounted on a drivable shaft and with teeth provided along its outer edge, as taught for example by U.S. Pat. No. 2,651,582 and, in an improved form, by German Auslegeschrift 1,186,039.

SUMMARY OF THE INVENTION

It is the principal object of the present invention to provide an apparatus for mixing at least two materials which, by decreasing the energy input, results in a reduction of the necessary mixing time and/or an improvement of the mixing results.

The foregoing object, as well as others which are to become clear from the text below, is achieved according to the invention by virtue of the fact that as an improvement in the apparatus at least the radially further outward circle of teeth on the rotor is disposed outside the radially outwardly located circle of teeth on the stator. Surprisingly, it has been found that this specific arrangement of the rotor relative to the stator, in the dispersal of solids in liquids, with equal fineness of dispersal, results in a reduction of the necessary dispersal time to one-fifth of the time required when using the known types of apparatus mentioned above. The total amount of energy required for a mixing process is simultaneously reduced by 75–80% of the energy expenditure which would otherwise be required. In addition, this means that the materials to be mixed are heated less strongly, and the cost and time of the cooling which would otherwise be necessary in many instances can also be reduced. This remarkable result can be explained by the fact that the individual particles of material and/or droplets of liquid, after passing through the circle of shearing slots which is located furthest outward radially receive a high tangential acceleration from those teeth on the rotor which are located furthest outward radially, and this results in the formation of very pronounced circular flows which guide all the small particles and/or droplets much more often per unit of time into the rotor-stator system, so that all the particles are subjected to extraordinarily high hydrodynamic shear stresses.

Furthermore, as a result of the design according to the present invention, cavitation phenomena develop in the shearing slots between the teeth of the rotor and of the stator, these forces being attributable to the fact that the teeth of the rotor, which are located outward relative to the teeth of the stator, produce an extremely low pressure in the shearing slot, this low pressure resulting in the liquid being converted to the vapor phase in a short period of time, and the vapor phase collapsing again immediately thereafter. In this fashion, the materials to be mixed or stirred undergo additional high accelerations. Moreover, agglomerates of solids break apart in the bubbles of vapor which are formed as the result of cavitation. It has been found extremely advantageous if the teeth are mounted on an annular disk of the stator and/or rotor which are concentric with one another and have a small radial distance between them. The fixed teeth of the stator and the passing teeth of the rotor can thus be mounted at an arbitrarily small distance from one another, i.e., the shearing slots between the teeth moving past one another relatively can be adjusted to fit the given conditions.

Advantageously, the teeth extend to both sides of the corresponding annular disk, so that circular flows can be produced which involve all of the contents of the container, i.e., there are no dead spaces in the container. The teeth of the rotor and the corresponding teeth of the stator have advantageously the same axial extent and are mounted parallel to each other. The full length of the teeth is consequently utilized to generate shear slots which are constant over their length.

At least one annular disk of the rotor is advantageously mounted by rotor arms to the shaft, which on the one hand produce additional tangential accelerations in the materials to be mixed, which contributes to further intensification of the circular flow. The rotor arms make it possible for axial flows to develop through the openings between them. For further intensification of the circular flows, the rotor arms, according to an advantageous embodiment of the invention, can be made scoop-shaped or propeller-like for tangential effects on the material.

Furthermore, it can be advantageous if the rotor arms have a slanting position which lifts the materials up from the bottom of the container. This can be particularly advantageous when solids are to be dispersed in a liquid, the solids exhibiting a very strong tendency to settle before the dispersion process begins. Advantageously, the annular disk of the stator is mounted to a stator tube surrounding the shaft by means of spokes, which make it possible for axial flows to develop through the openings between the spokes.

Advantageously, the teeth are made in the form of pins. Usually, apparatus constructed according to the present invention are used in such a way that the mixer is submerged vertically from above into a container, a feature similar to known mixing apparatus of this general type.

BRIEF DESCRIPTION OF THE DRAWING

Further advantages and features of the invention will be apparent from the description of an embodiment with reference to the drawing.

FIG. 2 is a side view of the stator of the apparatus of FIG. 1 in vertical cross section, shown enlarged.

FIG. 3 is a top view of one-half of the stator of FIG. 2.

FIG. 4 is a side view of the rotor of the apparatus of FIG. 1 in vertical cross section, shown enlarged.

FIG. 5 is a top view of one-half of the rotor of the apparatus of FIG. 4.

DESCRIPTION OF THE PREFERRED EMBODIMENT

Figure 1:
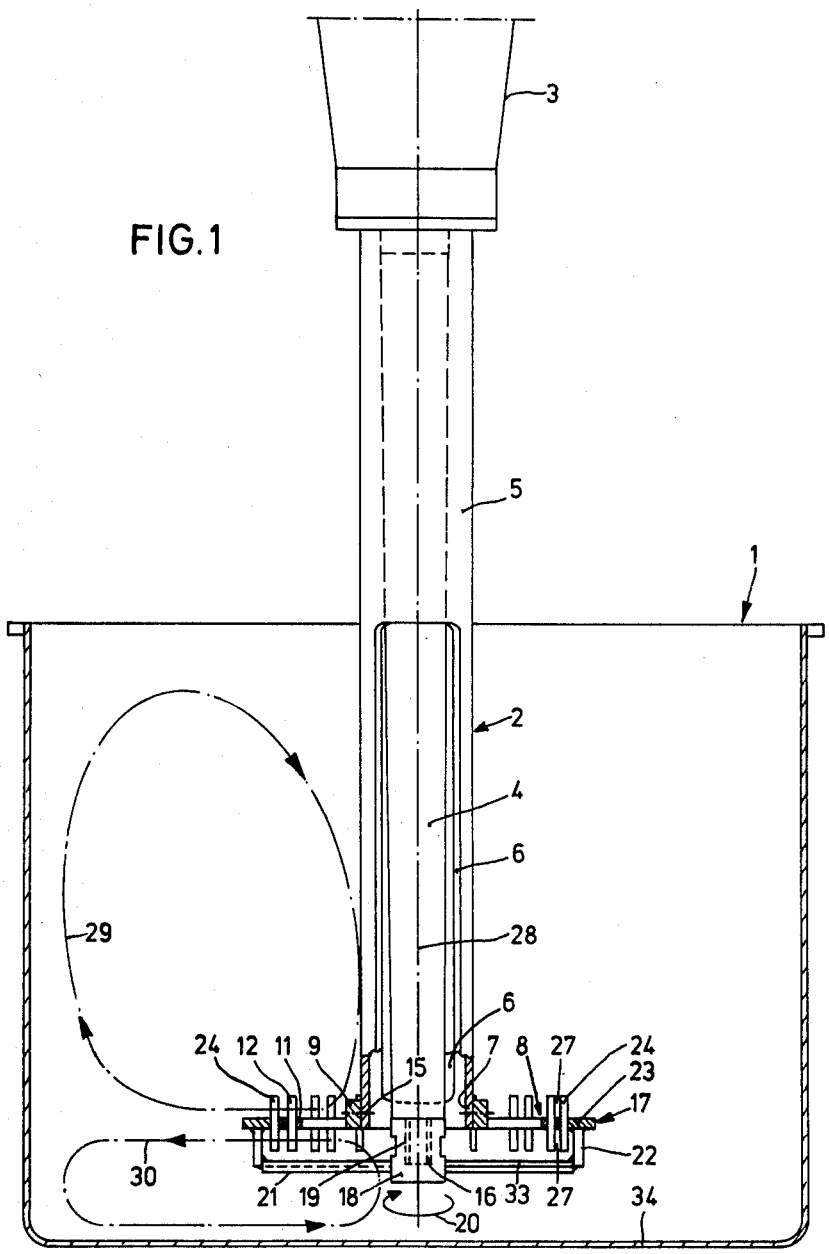
FIG. 1 is a side elevational view of an apparatus for mixing materials according to the invention in partial vertical cross section.

An apparatus for mixing materials according to the invention is provided with a substantially cylindrical container 1, open at the top, into which a mixer 2 is inserted from above. The mixer 2 is provided with a shaft 4 on a suspension mount in a housing 3, indicated generally, the shaft being drivable at high speed by a drive motor (not shown). Such arrangements are generally known and conventional in the paint mixing art. The shaft 4 is surrounded for most of its length by a stator tube 5, which is provided with two mutually opposite slots 6 extending lengthwise in the area submerged in the container 1, thus making it possible for example to clean the shaft 4. At the lower end of the stator tube 5 a mounting ring 7 is provided, to which a stator 8 is attached. The stator 8 consists of a hub ring 9, from which several spokes 10 extend radially, with an annular disk 11 mounted on these spokes. Teeth 12 in the form of pins are mounted on the annular disk 11, the pins being uniformly distributed over the circumference of the annular disk 11 in the vicinity of its outside edge 13. These cylindrical pins are pushed through corresponding holes 14 in the annular disk 11 and are welded thereto. The stator 8 is mounted on the mounting ring 7 by screws 15.

A thread 16 is provided at the lower free end of the shaft 4, and a rotor 17 is screwed onto this thread. The rotor 17 is provided with a hub 18, provided with a threaded bore 19, into which the thread 16 of the shaft 4 is screwable. The thread 16 and/or the thread of the threaded bore 19 has the same direction as the direction of rotation 20 of the shaft 4, so that when the shaft 4 is driven, the hub 18 cannot come loose from the shaft 4.

Propeller-like rotor arms 21 extend outward radially from the hub 18, these arms being welded to the hub 18. Because of their propeller-like design, the rotor arms 21 accelerate the media contained in the container 1 tangentially to their direction of movement. The rotor arms 19 are mounted diagonally with respect to the horizontal, as shown in the drawing.

At their radially outermost ends, vertical elements 22 are mounted on the rotor arms 21, these elements likewise being propeller-like or scoop-like. The vertical elements 22 support an annular disk 23 which fits around the annular disk 11 of stator 8 concentrically with a slight space between them, the annular disk 23 being welded to the vertical elements 22. The rotor arms 21 and the vertical pieces 22 naturally can also be made integral.

As on the annular disk 11 of the stator 8, teeth 24 in the form of pins are provided on the annular disk 23 of the rotor 17, these pins being fastened to holes 25 in the annular disk 23 by welding, and further being located in the vicinity of the inner edge 26 of the annular disk 23. The teeth 24 in the form of pins have the same diameter and same length as the teeth 12 made in the form of pins and also overlap in their lengthwise directions (see FIG. 1) so that when one tooth 24 on the rotor 17 passes a tooth 12 on the stator 8, a shearing slot 27 is formed whose width can be several millimeters. The teeth 12, 24 made in the form of pins are directed axially parallel to the axis of rotation 28 of the shaft 4. The vertical distance of the rotor arms 21 from the annular disks 11 and/or 23 is greater respectively than the length of the teeth 12 and/or 24, in the form of pins, projecting outward and downward from the respective annular disks 11 and/or 23.

The container 1 when used contains at least two different materials, at least one of which is a liquid. In operation, by driving the shaft 4 at an appropriately high speed, in the direction of rotation 20, the rotor 17 rotates relative to the stator 8 at a very high circumferential velocity for the teeth 24, which can be more than 50 m/sec. By virtue of this high circumferential velocity, the materials contained in the container 1 receive a high tangential acceleration from the rotor 17, this acceleration resulting in the fact that a strongly generated circular flow is produced which is indicated by streamlines 29 and 30. In FIG. 1, the streamlines 29 and 30 naturally show only the motion components that appear in a vertical cross section, while the rotational movement components cannot be shown. Naturally, three-dimensional flow is involved. According to the considerably simplified drawing showing the streamlines 29 and 30, a flow along the streamline 29 is produced which runs approximately outward radially through the part of shearing slot 27 which is located above the annular disks 11, 23, then upward and back into the vicinity of the shaft 4. Furthermore, a flow develops along the streamline 30, which runs radially outward through the part of the shearing slot 27 which is located below the annular disks 11, 23, then downward and back into the vicinity of the shaft 4. The flow along the streamline 30 can easily pass through a large opening 31 between the rotor arms 21 and the vertical elements 22. In addition, flows can be produced through openings 32 between the spokes 10 of the stator 8. By virtue of the fact that the annularly mounted teeth 24 of the rotor 17 surround radially and on the outside the likewise annularly disposed teeth 12 of the stator 8, after passing through the shearing slot 27 the materials receive additional strong tangential acceleration, so that very powerful circular flows are produced which ensure that all material particles are guided very frequently into the shearing slots 27. These circular flows are intensified even further by the propeller-like or scoop-like design of the rotor arms 21 and the vertical elements 22.

As indicated by the drawing, the rotor arms 21 have an upper sloping surface 33 which is upwardly inclined relative to the direction of rotation in the axial direction, these surfaces giving the liquid a slight, upwardly directed movement component, so that solids which are difficult to disperse cannot settle on the bottom 34 of the container 1.

Of course, an additional annular disk of the rotor 17 can be provided inside the annular disk 11 of the stator 8, and an additional annular disk of the stator 8 can be provided within the latter if desired.

Advantageously, the shaft 4 is driven through a continuously adjustable drive, so that the circumferential velocity of the rotor 17 can be adjusted optimally with respect to the materials to be mixed and/or stirred. Circumferential velocities of the rotor 17 in the range from 15 to 30 m/sec will suffice for most of the substances to be mixed.

It is to be understood that the foregoing description, as well as the accompanying drawing, relates to an illustrative embodiment of an apparatus for mixing set out by way of example, not by way of limitation. Numerous other embodiments and variants are possible without departing from the spirit and scope of the invention, its scope being set out in the appended claims.

What is claimed is:

1. In an apparatus for discontinuous mixing of at least two substances, of which at least one is a liquid, the apparatus including a container, a mixer disposed in the container, the mixer having a rotor drivable at high speed through a shaft and having a stator, and respective teeth disposed on the rotor and on the stator in mutually concentric circular planes for movement past one another to form shearing slots, the improvement wherein at least those teeth located most outward radially on said rotor are disposed in a circular plane outside that plane in which those of said teeth on said stator which are most radially outwardly positioned are located and wherein said teeth on said stator and said rotor are mounted respectively on mutually concentric annular disks of said stator and of said rotor with a small radial distance between said teeth on said rotor and said teeth on said stator, in adjacent circumferential planes and wherein said teeth extend to both sides of said corresponding annular disks.

2. An improved apparatus according to claim 1, wherein said annular disk of said stator is mounted by spokes to a stator tube surrounding said shaft.

3. An improved apparatus according to claim 1, wherein said annular disk of said rotor is mounted to said shaft by rotor arms.

4. An improved apparatus according to claim 3, wherein said rotor arms are made scoop-shaped or propeller-like for conferring tangential acceleration to the materials in said container.

5. An improved apparatus according to claim 3, wherein said rotor arms have a tilted position which lifts the material from the bottom of said container.

6. An improved apparatus according to claim 1, wherein said teeth of said rotor and the corresponding said teeth of said stator have the same axial extent.

7. An improved apparatus according to claim 1, wherein said teeth of said rotor and of said stator are mounted parallel to one another.

8. An improved apparatus according to claim 1, wherein said teeth are made in the form of pins.

* * * * *